US012285086B2

(12) United States Patent
Walsh

(10) Patent No.: US 12,285,086 B2
(45) Date of Patent: Apr. 29, 2025

(54) NECKLACE SHORTENER

(71) Applicant: Daria Walsh, Doylestown, PA (US)

(72) Inventor: Daria Walsh, Doylestown, PA (US)

( * ) Notice: Subject to any disclaimer, the term of this patent is extended or adjusted under 35 U.S.C. 154(b) by 0 days.

(21) Appl. No.: 17/697,060

(22) Filed: Mar. 17, 2022

(65) Prior Publication Data

US 2022/0202148 A1 Jun. 30, 2022

Related U.S. Application Data

(63) Continuation of application No. 16/421,690, filed on May 24, 2019, now Pat. No. 11,278,086.

(60) Provisional application No. 62/677,039, filed on May 27, 2018.

(51) Int. Cl.
*A44C 5/20* (2006.01)
*A44C 15/00* (2006.01)

(52) U.S. Cl.
CPC ..... *A44C 5/209* (2013.01); *A44C 15/005* (2013.01)

(58) Field of Classification Search
CPC ..... A44C 5/18; A44C 5/185; A44C 5/2071; A44C 5/209; A44C 5/2095; A44C 5/22; A44C 5/24; A44C 5/243; A44C 5/246; A44C 13/00; A44C 15/005; A44C 11/06; A44C 11/14; F16B 2/10
See application file for complete search history.

(56) References Cited

U.S. PATENT DOCUMENTS

| | | | | |
|---|---|---|---|---|
| 1,746,054 | A | 2/1930 | Budd | |
| 2,453,993 | A * | 11/1948 | Kreisler | F16B 45/027 24/906 |
| 3,181,217 | A * | 5/1965 | :Unselected: | A44C 5/209 24/116 A |
| 3,271,977 | A * | 9/1966 | Bohlinger | A44C 5/209 63/3.2 |
| 4,530,221 | A | 7/1985 | Weinberg | |
| 4,549,411 | A | 10/1985 | Ivey | |
| 4,628,708 | A * | 12/1986 | Ivey | A44C 11/00 63/3 |
| D295,505 | S * | 5/1988 | Watts | D11/87 |
| 4,754,534 | A * | 7/1988 | Helwick | A44C 5/2095 63/3.2 |
| 4,774,743 | A * | 10/1988 | Ziemelis | A44C 5/2042 24/616 |
| D331,725 | S | 12/1992 | Mastoloni | |
| 5,168,606 | A * | 12/1992 | Ziemelis | A44C 5/2042 24/116 A |
| 5,687,585 | A | 11/1997 | Ferrell | |
| 9,173,459 | B2 * | 11/2015 | Gisser | A44C 5/2095 |
| 10,602,815 | B2 | 3/2020 | Rohde | |
| 2016/0166020 | A1 * | 6/2016 | Lovett | A44C 15/005 63/3 |
| 2021/0045501 | A1 * | 2/2021 | Muenmai | A44B 13/02 |

* cited by examiner

*Primary Examiner* — Joshua T Kennedy
(74) *Attorney, Agent, or Firm* — Price Heneveld LLP

(57) ABSTRACT

A jewelry shortener for temporarily shortening a jewelry chain comprises a clasp with a cushion element that traps both sides of the chain at a desired length when the clasped is dosed. The clasp may or may not have an ornamental element that is visible when worn.

20 Claims, 3 Drawing Sheets

NECKLACE SHORTENER

This application is a continuation of U.S. patent application Ser. No. 16/421,690, filed May 24, 2019, now U.S. Pat. No. 11,278,086, which in turn claims the benefit of U.S. Provisional Application Ser. No. 62/677,039, filed May 27, 2018, the contents of all the aforementioned applications incorporated herein by reference.

BACKGROUND

The present invention relates to the field of jewelry. More particularly, the present invention relates to a clasp for temporarily shortening the length of necklace chains and the like.

Long necklaces are a popular jewelry item in the fashion world; however, these necklaces are not always the appropriate length for certain clothing ensembles and it is desirable for users to have a way to adjustably shorten the length of these necklaces without permanently altering them.

Many necklaces do not have a built-in mechanism for shortening length since their clasp closure may be too large or unable to latch onto the attached necklace strands or they are created as a continuous strand without a closure. Most known devices for shortening necklaces have focused primarily on the shortening of pearls or beads which are designed to grasp the necklace in between the individual pearls or beads thus holding the strands in place, however these devices are not suitable for chain necklaces and the like due to their design which requires the strands to have pearls, beads, or charms to prevent slipping.

Few options exist for small link necklace chains, such as rope chains, box chains and the like, as well as various other styles and strand materials known in the art, for which temporary shortening poses a challenge and it would be desirable to have a necklace clasp with the ability to shorten these types of necklaces for which current devices are not suitable. There is therefore a need for an improved necklace shortener with the ability to temporarily shorten chain necklaces and the like, as summarized, discussed in detail, and claimed in the following text and accompanying illustrations.

SUMMARY

The present invention is a device for temporarily shortening the length of jewelry chains and the like.

One embodiment of the present invention comprises a clasp adapted to trap a jewelry chain passing through the clasp in a transverse direction to the chain, wherein the clasp is comprised of a top member hingedly attached to a bottom member on a first side, and a closure mechanism on a second side, and has an open and dosed position. In the dosed position, the top member has an exterior surface and an interior surface and the bottom member has an exterior surface and an interior surface. A cushion dement is fixedly attached to the interior surface of at least one of the top member and the bottom member and is adapted to hold jewelry chains inside the clasp without slipping when engaged in a dosed position.

Another embodiment of the present invention comprises a clasp adapted to trap a jewelry chain passing through the clasp in a transverse direction to the chain, wherein the clasp comprises a top member hingedly attached to a bottom member on a first side and a closure mechanism on a second side and has an open position and a dosed position. When in the dosed position, the top member has an exterior surface and an interior surface and the bottom member has an exterior surface and an interior surface and at least one interior surface has at least two prongs extending into the interior space between the top member interior surface and the bottom member interior surface, dividing the interior space into at least two cavities. At least one cushion dement is held in place in the interior space by said prongs wherein the cushion dement is adapted to hold the jewelry chains inside the clasp without slipping when engaged in the dosed position.

Another embodiment of the present invention comprises a clasp adapted to trap a jewelry chain passing through the clasp in a transverse direction to the chain, wherein the clasp comprises a top member hingedly attached to a bottom member on a first side and a closure mechanism on a second side, wherein the clasp has an open position and a dosed position. When in the dosed position, the top member has an exterior surface and an interior surface and the bottom member has an exterior surface and an interior surface, describing an interior space that is substantially tilled by at least one cushion element adapted to hold the jewelry chains inside the clasp without slipping when engaged in the dosed position.

The word jewelry chain is not meant to be limiting and may include other strands, cords, or strings known in the art as well as be constructed of various materials such as leather, fabric, metal, or plastic and may refer to parts of a necklace, bracelet, anklet or other known jewelry items.

In some forms, the clasp may be made of precious metals, non-precious base metals, plastic, wood, or a mixture of materials known in the art that provide rigid structure to the clasp.

In some forms, the clasp may be a fold-over clasp, however in alternative embodiments the clasp may be an alligator clasp, a claw clasp, or various other styles known in the art.

In some forms, the interior space may be divided into at least two cavities by at least two prongs which hold the individual jewelry strands in place between the prongs in a transverse direction to the clasp when engaged in the operation for shortening. In some forms, a single prong or protrusion may divide the interior space into discreet cavities.

In some forms, at least one cushion element may be made of silicone, silicone rubber, closed-cell foams such as EVA foam, open cell foams, foam rubber, natural or synthetic rubber, or other resiliently compressible materials known in the art and may contain coloring agents. In some forms, the cushion element may substantially fill the space between the top member interior surface and the bottom member interior surface when the clasp is in a dosed position. By substantially fills the space, it is meant that the cushion element may fill the interior space of the clasp by at least 80% when engaged in a dosed position. In other forms, where two or more cushion elements are used, the cushion elements together may substantially fill the interior space by at least 80% combined between the top member and the bottom member.

In some forms, the cushion element may be fixedly attached to the Interior surface of at least one top member or bottom member of the clasp by the use of adhesives to bond the cushion element to the interior surface, or by way of other methods known in the art. In other forms, at least one cushion element is held in place inside the interior space of the clasp without or with minimal use of adhesives by arranging the cushion element between the double prongs and the first and second end of the interior of the clasp.

In some forms, the cushion element may be integral to at least one of the top or bottom member. In this form, the cushion element may be integral to the top or bottom member of the clasp or may be integral to both the top and bottom member.

In some forms, the clasp may further comprise an ornamental element. In some forms, the ornamental element may be fixedly attached the top member or the bottom member or both the top member and the bottom member. In some forms, the ornamental element may be integral to at least one of the top or bottom member or both the top and bottom member.

The ornamental element may comprise precious, semi-precious or artificial stones, gems, crystals, beads, precious or base metals or various other ornamental materials known in the art and provides an item of jewelry in certain embodiments that is both ornamental and functional.

In some forms, the clasp may further comprise a locking element to allow the top member to be further secured to the bottom member and prevent the clasp from opening when in a locked position. The locking element may be a single or double safety latch, a hook safety latch, a FIG. "8" safety latch, a revolver safety latch, a push-pull safety latch or other locking elements known in the art.

In some forms, the top member and bottom member may have a length and a width in which the width of the top member is less than the width of the bottom member. An example of this is a top member comprised of a pin or post.

According to further aspects of the present invention, a method for shortening comprises placing two portions of a jewelry chain inside the clasp in a transverse direction to the clasp at the user's desired length around their neck and engaging the clasp in a dosed position thus holding the chain in place without slipping.

In some forms, in which the top member or bottom member may be comprised of a pin or post, a further method for shortening may comprise inserting the pin or post through holes in two segments of a jewelry chain and then enclosing the two segments of the jewelry chain in a transverse direction to the clasp at the user's desired length around theft neck, thus holding the chain in place without slipping when the clasp is engaged in a closed position.

Thus, the objects of the invention to provide an improved necklace shortener with the ability to temporarily shorten chain necklaces and the like has been achieved.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

The following detailed description includes references to the accompanying illustrations which form a part of this detailed description. Example embodiments are described in enough detail to enable those skilled in the art to practice the present subject matter. However, it will be apparent to one of ordinary skill in the art that the present invention may be practiced without some of these specific details, in other instances, well-known methods, procedures, and components have not been described in detail so as not to unnecessarily obscure aspects of the embodiments. The embodiments can be combined, other embodiments can be utilized, or structural and method of use changes can be made without departing from the scope of what is defined and claimed. The following detailed description is, therefore, not to be taken as a limiting sense, and the scope is defined by the appended claims and their equivalents which are to be understood in their broadest possible sense.

In this document, the terms "a" or "an" are used, as is common in patent documents, to include one or more than one. Furthermore, the term "or" is used to refer to a nonexclusive "or," such that "A or B" includes "A but not B," "B but not A," and "A and B," unless otherwise indicated.

BRIEF DESCRIPTION OF THE DRAWINGS

Embodiments of the described apparatus are illustrated by way of example in the figures of the accompanying drawing sheets, in which like references indicate similar dements and in which.

DETAILED DESCRIPTION

Figure 1:
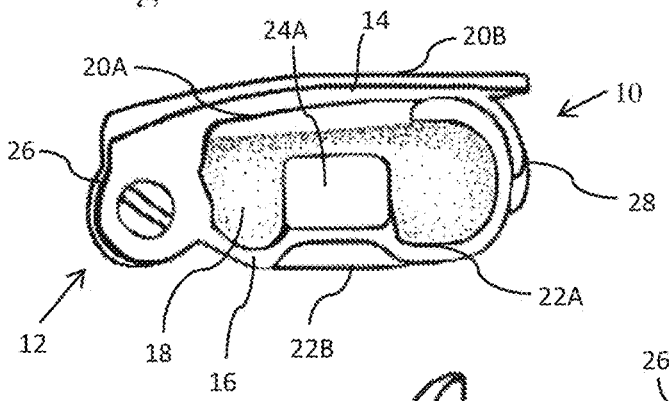
FIG. 1 is front side elevational view of a necklace shortener embodying one form of the present invention in the dosed position.
Figure 2:
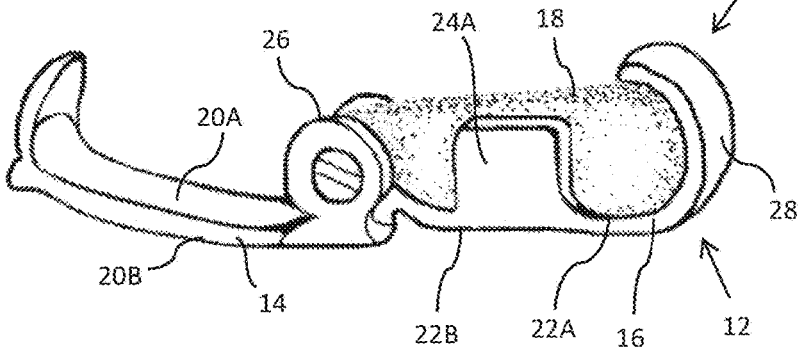
FIG. 2 is a front side perspective view of the embodiment shown in FIG. 1 in the open position.
Figure 3:
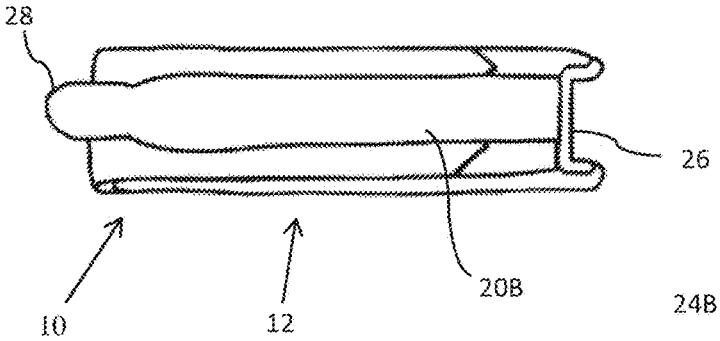
FIG. 3 is a top plan view of a necklace shortener of the embodiment shown in FIG. 1.
Figure 4:
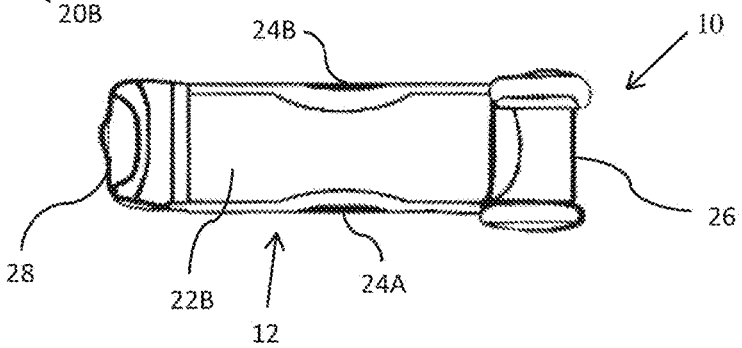
FIG. 4 is a bottom plan view of a necklace shortener of the embodiment shown in FIG. 1.

Referring now to the invention in more detail, in FIGS. 1-5, there is shown a necklace shortener 10, according to a first embodiment, comprising a clasp 12 and cushion element 18. Clasp 12 is comprised of a top member 14 having an interior top member 20A and exterior top member 20B, a bottom member 16 having an interior bottom member 22A and exterior bottom member 22B. Top member 14 is attached to bottom member 116 by hinge 26 on a first side and having a closure mechanism 28 on a second side. Hinge 26 allows top member 14 to move from an open position as shown in FIG. 2 to a dosed position as shown in FIG. 1. Closure mechanism 28 allows top member 14 to engage with bottom member 16 to hold clasp 12 in a dosed position, as shown in FIG. 1.

Figure 6:
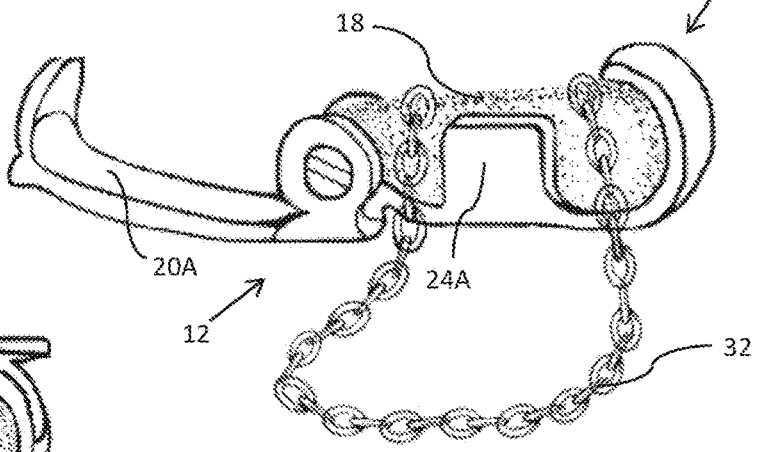
FIG. 6 is a front side perspective view illustrating a necklace shortener of the embodiment of FIG. 2 shown at one step of the operation for shortening with parts open and portions of a necklace.
Figure 7:
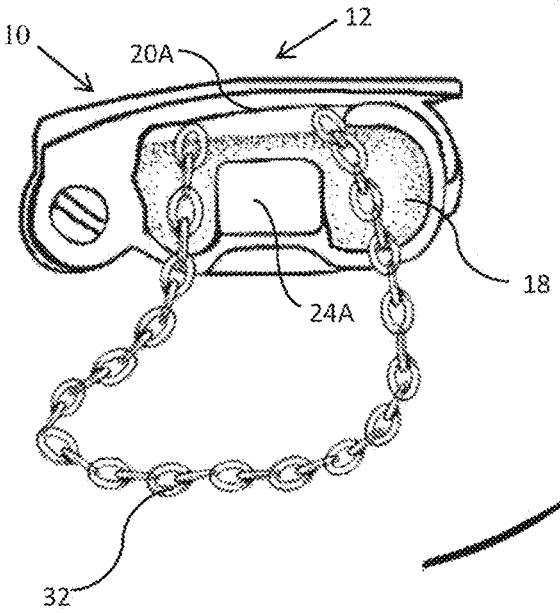
FIG. 7 is a front side elevational view illustrating the necklace shortener of the embodiment of FIG. 1 shown at another step of the operation for shortening with parts dosed around portions of a necklace.
Figure 8:
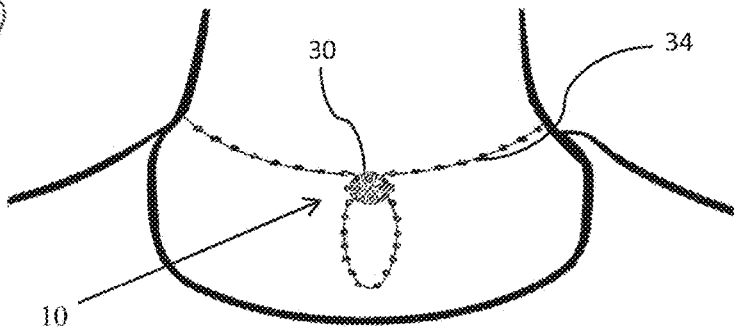
FIG. 8 is a back elevational view of the neck of a user wearing a chain illustrating an embodiment of the invention in use.

Bottom member 16 comprises double prongs 24A and 248 centrally located along the edges of interior bottom member 22A, and evenly spaced between hinge 26 and closure mechanism 28 which divides the interior space into two cavities which hold the individual jewelry strands in place between double prongs 24A and 24B in a transverse direction to the clasp 12 when engaged in the operation for shortening as shown in FIGS. 6-8 in this particular embodiment.

Cushion element 18 substantially fills the interior space of clasp 12 and is fixedly attached along interior bottom member 22A, between double prongs 24A and 248, and hinge 26 on a first side and closure mechanism 28 on a second side and is adapted to hold jewelry chains inside the clasp without slipping when engaged in a closed position as shown in FIG. 7, in this particular embodiment.

Clasp 12 in this particular embodiment, preferably measures approximately 10 mm×3 mm×5 mm but can be scaled to accommodate larger or smaller jewelry chains and the like.

Cushion element 18 substantially fills the interior space of clasp 12 at least 80% between the interior bottom member 22A and interior top member 20A and may be comprised of dosed cell foam materials, such as EVA foam in this particular embodiment, but may be comprised of silicone, silicone rubber, open cell foams, foam rubber, natural or synthetic rubber, or other resiliently compressible materials known in the art and may also contain coloring agents.

Cushion element 18 in this particular embodiment is fixedly attached and held in place inside the interior space of the clasp 12 without or with minimal use of adhesives by arranging the cushion element 18 between the double prongs 24A and 24B and hinge 26 on a first side and closure mechanism 28 on a second side of the interior of clasp 12. However, in some forms, the cushion element 18 may be fixedly attached to at least one interior top member 20A or interior bottom member 22A by the use of adhesives to bond the cushion element 18 to the interior surface, or by way of other methods known in the art.

Figure 5:
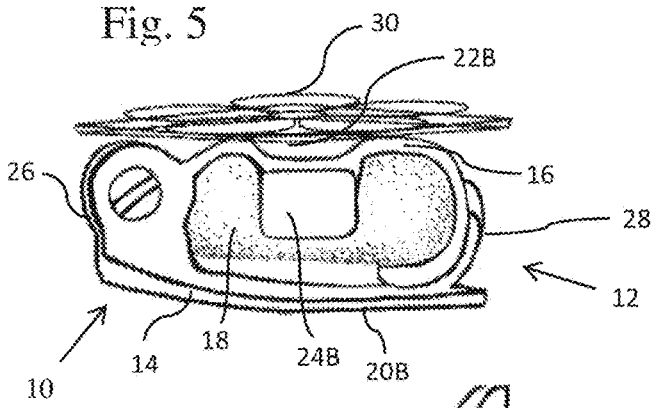
FIG. 5 is a rear side elevational view of the embodiment shown in FIG. 1 with optional ornamental element.

In FIG. 5, there is shown a rear side elevational view of the embodiment shown in FIG. 1 with optional ornamental element 30 attached to the exterior bottom member 228 in this particular embodiment, however ornamental element 30 may be attached to the exterior top member 208, both the exterior top member 208 and exterior bottom member 228 or may be integral to the top member 14, the bottom member 16 or be integral to both the top member 14 and bottom member 16 in alternative embodiments.

Referring now to FIGS. 6-8 there is shown a necklace shortener 10 according to the present invention, illustrating in Fla 6, a front side perspective view illustrating a necklace shortener 10 of the embodiment of FIG. 2 shown at one step of the operation for shortening with parts open and portions of a necklace 32, and in FIG. 7, a front side elevational view illustrating the necklace shortener 10 of the embodiment of FIG. 1 shown at another step of the operation for shortening with parts dosed around portions of a necklace 32, and in FIG. 8, a back elevational view of the neck of a user wearing a chain illustrating an embodiment of the invention in use.

According to this embodiment, the operation for shortening comprises placing two portions of a necklace 32 inside clasp 12 in a transverse direction to clasp 12, as shown in FIG. 6, at the users desired length around theft neck and then engaging the clasp 12 in a dosed position, thus holding the portions of a necklace 32 in place without slipping between cushion 18 and interior top member 20A as shown in FIG. 7 and demonstrated in use in FIG. 8.

The two cavities created by double prongs 24A and 248, in this embodiment, may further assist in holding the portions of a necklace 32 inside the clasp 12 when placed on each side of the double prongs 24A and 248 and engaged in the dosed position in the operation for shortening.

In more detail, referring to FIG. 8, necklace shortener 10 clasps the chains of a necklace 34 together at the users desired length along the back of the user's neckline with optional ornamental embellishment 30 facing out, however alternative methods may be used.

Figure 9:
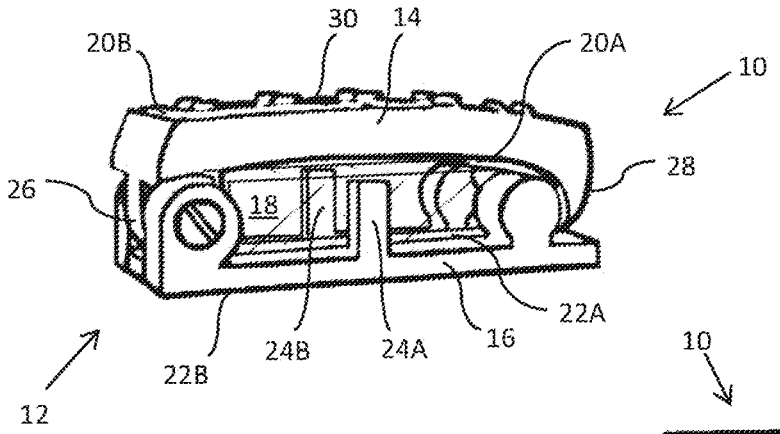
FIG. 9 is a front side perspective view of a necklace shortener in the dosed position of another embodiment of the present invention.
Figure 11:
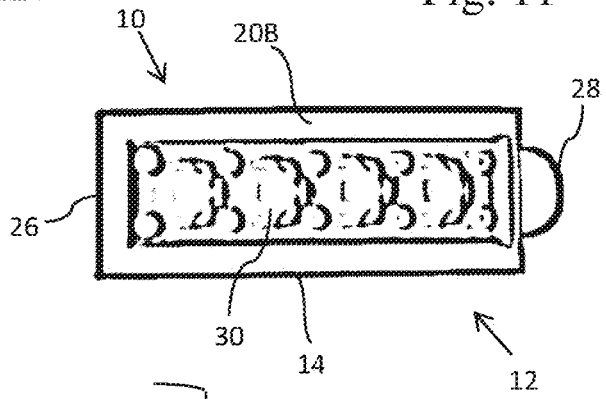
FIG. 11 is a top plan view of the embodiment shown in FIG. 9.
Figure 10:
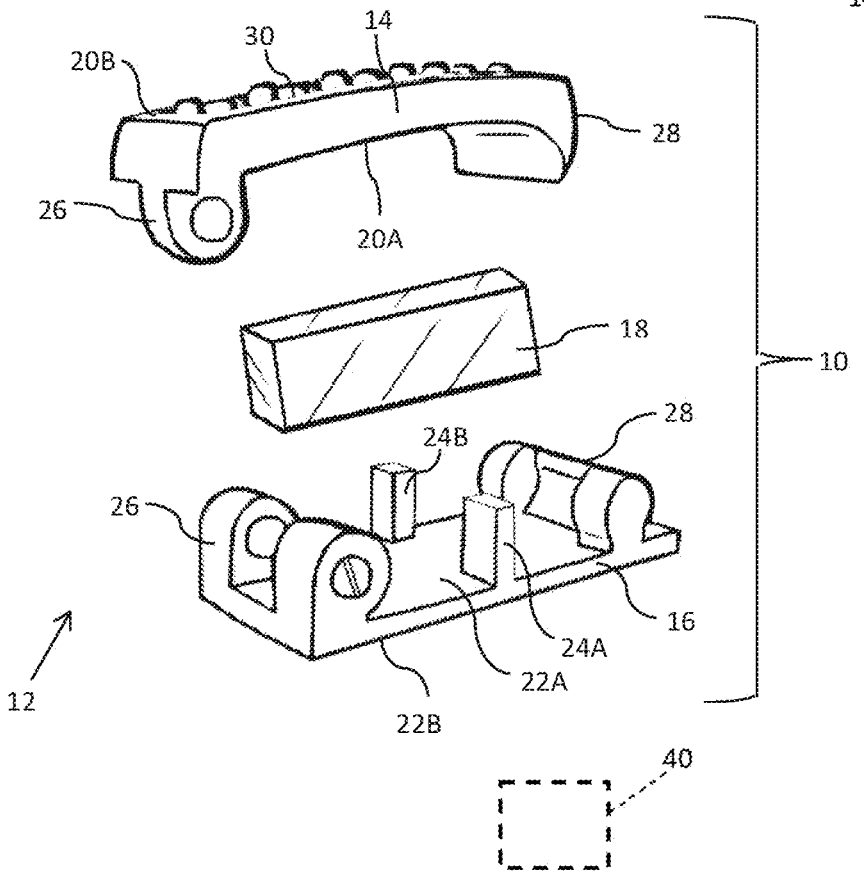
FIG. 10 is an exploded view of the embodiment shown in FIG. 9.

FIGS. 9-11 is shown another embodiment of necklace shortener 10 of the present invention, in which corresponding parts are identically numbered.

In this embodiment, clasp 12 is also comprised of a top member 14 having an interior top member 20A and exterior top member 20B, a bottom member 16 having an interior bottom member 22A and exterior bottom member 228 and demonstrates an alternative clasp 12 shape to the necklace shortener 10 of the embodiment shown in FIG. 1. Top member 14 is also attached to bottom member 16 by hinge 26 on a first side and having a closure mechanism 28 on a second side. Hinge 26 similarly allows top member 14 to move from an open position to a dosed position and closure mechanism 28 allows top member 14 to engage with bottom member 16 to hold clasp 12 in a dosed position, in a similar manner as shown in the embodiment described in FIGS. 1 and 2.

Bottom member 16 of this embodiment similarly comprises double prongs 24A and 24B shown in an alternative shape to the embodiment of FIG. 1, which are also centrally located along the edges of interior bottom member 22A, and evenly spaced between hinge 26 and closure mechanism 28, dividing the interior space into two cavities which hold the portions of a necklace 32 in place between the double prongs 24A and 24B in a transverse direction to the clasp 12 when engaged in the operation for shortening as demonstrated in FIGS. 6-8.

Cushion element 18 also substantially fills the interior space of clasp 12 by at least 80% and is fixedly attached along interior bottom member 22A, between double prongs 24A and 24B, and hinge 26 on a first side and closure mechanism 28 on a second side. Cushion element 18 is shown in a clear silicone material in this particular embodiment, and is similarly adapted to hold jewelry chains inside the clasp without slipping when engaged in a dosed position of the shortening operation.

Clasp 12 in its assembled form of this particular embodiment, preferably measures approximately 12 mm×4.5 mm×4.4 mm but can also be scaled to accommodate larger or smaller jewelry chains and the like.

In this particular embodiment, ornamental element 30 is integral to the top member 14 but in other forms may be integral to bottom member 16 or both top member 14 and bottom member 16 or attached to the exterior top member 20B or the exterior bottom member 22B or both the top exterior member 20B and the exterior bottom member 22B.

In the embodiments described, clasp 12 is preferably made of precious or base metal, but other materials may be used such as plastic, wood, or a mixture of materials known in the art that provide the rigid structure required to perform its function.

Clasp 12, in these particular embodiments is shown as a fold-over clasp, however in alternative embodiments clasp 12 may be an alligator clasp, a claw clasp, or various other styles known in the art.

In the embodiment described, double prongs 24A and 248 divide the interior space into two cavities which hold the individual portions of a necklace 32 in place between double prongs 24A and 24B in the operation for shortening described in FIGS. 6-8. In alternative forms, the double prongs 24A and 248 may be omitted and not necessary for performing the transverse operation for shortening. In this form, at least one or more cushion elements may be fixedly attached along at least one of the top interior member 20A or bottom interior member 22A or integral to the top member 14 or bottom member 16 of the clasp 12.

In some forms, a single prong or protrusion may divide the interior space into discreet cavities.

In some forms, clasp 12 may further comprise a locking element 40 to allow the top member to be further secured to the bottom member and prevent the clasp from opening when in a locked position. The locking element 40 may be a single or double safety latch, a hook safety latch, a FIG. "8" safety latch, a revolver safety latch, a push-pull safety latch or other locking elements known in the art.

Ornamental element 30 may comprise precious, semi-precious or artificial stones, gems, crystals, beads, precious or base metals or various other materials known in the art and may provide an item of jewelry in certain embodiments that is both ornamental and functional.

In some forms, at least one cushion element may be made of silicone, silicone rubber, closed-cell foam such as EVA foam, open cell foam, foam rubber, natural or synthetic rubber, or other resiliently compressible materials known in the art and may contain coloring agents.

In some forms, the cushion element 18 may be fixedly attached to the surface of at least one top interior member 20A or interior bottom member 22A of the clasp 12 by the use of adhesives to bond the cushion element 18 to the interior surface, or by way of other methods known in the art. In other forms, at least one cushion element 18 is held in place inside the interior space of the clasp without or with minimal use of adhesives by arranging the cushion element between the double prongs 24A and 248 and hinge 26 on a first side and closure mechanism 28 on a second side of the interior of the clasp 12.

In some forms, the cushion element may be integral to the top member 14 or bottom member 16 of the clasp 12 or may be integral to both the top member 14 and bottom member 16.

Additionally, in some forms two or more cushion dements 18 may be used. In this form, the cushion elements 18 together may substantially fill the interior space by at least 80% combined between the top member 14 and the bottom member 16.

The word necklace chain is not meant to be limiting and may include other jewelry strands, cords, or strings known in the art as well as constructed of various materials such as leather, fabric, metal or plastic and may refer to portions of a necklace, bracelet, anklet or other known jewelry items.

According to the embodiments described, a method for shortening comprises placing two portions of a necklace 32 inside clasp 12 in a transverse direction to the clasp 12 at the user's desired length around their neck and engaging the clasp 12 in a dosed position, thus holding the portions of a necklace 32 in place without slipping, however alternative methods for shortening may be used.

In some forms, the top member 14 and bottom member 16, may have a length and a width in which the width of the top member 14 is less than the width of the bottom member 16. An example of this is a top member 14 comprised of a pin or post. In this form, a further method for shortening may comprise inserting the pin or post through holes in two segments of a jewelry chain and then enclosing the two segments of the jewelry chain in a transverse direction to the clasp 12 at the users desired length around their neck, by engaging the clasp 12 in a dosed position, thus holding the chain in place without slipping.

The advantages of the present invention include, without limitation, a necklace shortener with the ability to temporarily shorten the length of jewelry chains, such as box chains, or various other styles of necklace strands that are known in the art for which temporary shortening poses a challenge while also providing an item of jewelry in certain embodiments that is ornamental and functional.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention as claimed.

What is claimed is:

1. A shortener device comprising:

a top member attached to a bottom member by a hinge on a first side of the shortener device, wherein the top member has a first curved end, and wherein the bottom member includes extensions on opposing edges thereof at the first side of the shortener device that extend toward a second end and form a portion of the hinge;

a closure mechanism located on the second side of the shortener device, wherein a bottom member of the closure mechanism has a second curved end defining an inner recess between at least partially circular sections that extend toward the first side, wherein the first curved end conforms to and overlaps the second curved end to hold the top member to the bottom member when in a closed position, wherein the first curved end has a distal end portion that contacts a surface of the bottom member of the closure mechanism, wherein the second curved end contacts an interior surface of the top member when in the closed position;

an interior space formed between the top member and the bottom member, the interior space divided into discreet cavities, wherein each of the discreet cavities is adapted to secure a non-free end portion of jewelry; and a cushion element secured within said interior space by being disposed between and engaging the extensions on the first side and being disposed between and engaging the at least partially circular sections at the second side, wherein the entirety of space formed by the second curved end is filled with the cushion element.

2. The shortener device of claim 1, wherein the cushion element is adapted to secure at least one of a group consisting of strands, cords, and strings.

3. The shortener device of claim 1, wherein the cushion element is adapted to secure at least one of a group consisting of necklaces, bracelets, and anklets.

4. The shortener device of claim 1, wherein there are at least two discreet cavities that are evenly spaced from where the top member is attached to the bottom member and the closure mechanism.

5. The shortener device of claim 1, wherein the top member is attached to the bottom member with a non-living hinge that is rotatably movable between the extensions, the extensions forming two partially circular sections of the bottom member.

6. The shortener device of claim 1, wherein there are only two discreet cavities evenly spaced from where the top member is attached to the bottom member and the closure mechanism.

7. The shortener device of claim 1, further comprising:

a locking element adapted to secure the top member to the bottom member.

8. The shortener device of claim 7, wherein the locking element is selected from a group consisting of a single safety latch, a double safety latch, a hook safety latch, revolver safety latch, and a push-pull safety latch.

9. The shortener device of claim 1, wherein the cushion element is formed from silicone.

10. The shortener device of claim 1, wherein the cushion element is selected from a group consisting of silicone rubber, closed-cell foam, open-cell foam, foam rubber, and rubber.

11. The shortener device of claim 1, wherein the top member comprises an ornamental element.

12. A method for shortening jewelry comprising:

providing a clasp device comprising:

a top member attached to a bottom member on a first side of the clasp device, wherein the top member has a first curved end, and wherein the bottom member includes first extensions on opposing edges thereof at the first side of the clasp device that extend toward a second side;

a closure mechanism located on the second side of the clasp device adapted to secure the top member to the bottom member, wherein a bottom member of the closure mechanism has a second curved end defining an inner recess between second extensions that extend toward the first side, wherein the first curved end conforms to and overlaps the second curved end when closed, wherein the first curved end has a distal end portion that contacts an outer surface of the bottom member of the closure mechanism, wherein the second curved end contacts an interior surface of the top member when in a closed position; and an interior space formed between the top member and the bottom member, the interior space divided into discreet cavities, wherein each of the discreet cavities is adapted to secure a portion of jewelry with a cushion element, wherein the entirety of space formed by the second curved end is filled with the cushion element, and wherein the cushion element is disposed between and engages the first extensions on the first side and is disposed between and engages the second extensions on the second side;

opening the clasp device by disengaging the first curved end from the outer surface of the second curved end;

placing the portion of jewelry within at least one of the discreet cavities, wherein placement of the portion of jewelry shortens a length of the jewelry when worn as compared to length of the jewelry when worn without use of the clasp device;

closing the clasp device, wherein closure of the clasp device results in a shortened length of the jewelry as compared to length of the jewelry when worn without use of the clasp device;

holding the portion of the jewelry between the cushion element and the top member to retain the shortened length of the jewelry; and locking the clasp device in the closed position with a latch.

13. The method of claim 12, wherein the cushion element is adapted to secure at least one of a group consisting of strands, cords, and strings.

14. The method of claim 12, wherein the cushion element is adapted to secure at least one of a group consisting of necklaces, bracelets, and anklets.

15. The method of claim 12, wherein the discreet cavities are evenly spaced from the first side and the second side.

16. The method of claim 12, wherein the top member is attached to the bottom member with a non-living hinge that is rotatably movable between the first extensions configured as two partially circular sections of the bottom member.

17. The method of claim 12, wherein there are only two discreet cavities evenly spaced from the first side and the second side.

18. The method of claim 12, wherein the latch is selected from a group consisting of a single safety latch, a double safety latch, a hook safety latch, revolver safety latch, and a push-pull safety latch.

19. A shortener device, comprising:

a first member including:

a first hinge portion extending in a first direction from a first end; and a curved first closure portion extending in the first direction at a second end;

a second member including:

a second hinge portion including walls at opposing edges at a first end of the second member, wherein the first hinge portion is disposed between the two walls to form a hinge, wherein the walls extend toward a second end of the second member to define a first recess; and a second closure portion including outer walls and a connecting wall extending between the outer walls, wherein the outer walls extend toward the first end to define a second recess, and wherein the connecting wall defines a curved outer surface, and further wherein the curved first closure portion is configured to fit over and extend along the curved outer surface of the second closure portion to close the shortener device;

at least one cushion element disposed between and engaging the walls of the second hinge portion in the first recess and disposed between and engaging the outer walls of the second closure portion in the second recess; and a locking latch to secure the first member to the second member when the curved first closure portion is fit over the second closure portion in a closed position.

20. The shortener device of claim 19, further comprising:

prongs extending from the opposing edges of the second member between the walls of the second hinge portion and the outer walls of the second closure portion, wherein the at least one cushion element engages inner surfaces of the prongs to couple the at least one cushion element to the second member.

* * * * *